United States Patent [19]

Ostwald

[11] Patent Number: 4,947,504

[45] Date of Patent: Aug. 14, 1990

[54] SPONGE MOP

[76] Inventor: Judith D. Ostwald, 2025 Walnut St., Oshkosh, Wis. 54091

[21] Appl. No.: 389,269

[22] Filed: Aug. 3, 1989

[51] Int. Cl.[5] ..... A47L 13/12

[52] U.S. Cl. ..... 15/119 A; 15/118; 15/119 R

[58] Field of Search ..... 15/119 A, 119 R, 244.1, 15/244.2, 228, 118, 116.1, 116.2

[56] References Cited

U.S. PATENT DOCUMENTS

| | | | |
|---|---|---|---|
| 2,304,127 | 12/1942 | Stetson | 15/118 |
| 2,637,059 | 5/1953 | Vosbikian et al. | 15/119 A |
| 2,774,092 | 12/1956 | Vaughn | 15/119 A |
| 2,834,974 | 5/1958 | Greenleaf | 15/119 A |
| 2,858,557 | 11/1958 | Zottola | 15/119 A |
| 2,864,107 | 12/1958 | Greenleaf | 15/119 A |
| 3,008,163 | 11/1959 | Bommer | 15/118 |
| 3,026,554 | 3/1962 | Palma et al. | 15/119 A |
| 3,038,188 | 6/1962 | Rebernak | 15/119 A |
| 3,142,855 | 8/1964 | Gilchrist | 15/244.1 |
| 3,224,025 | 12/1965 | Altrock | 15/119 A |
| 3,293,684 | 12/1966 | Tundermann | 15/244.1 |

FOREIGN PATENT DOCUMENTS

| | | | |
|---|---|---|---|
| 466474 | 7/1950 | Canada | 15/119 A |

*Primary Examiner*—Harvey C. Hornsby
*Assistant Examiner*—G. Graham
*Attorney, Agent, or Firm*—Donald Cayen

[57] ABSTRACT

An improved sponge mop includes a wringing mechanism for squeezing water from a sponge. The sponge extends several inches beyond the perimeter of the wringing mechanism to reach into a toespace without damaging the overhanging cupboard, cabinet, or other furniture item. The sponge has bevels on the ends thereof that facilitate cleaning corners within the toespace. The sponge is in two layers with a reinforcement plate sandwiched therebetween. The reinforcement plate enables water to be squeezed from the extended sponge ends when the sponge is folded against itself for wringing.

8 Claims, 2 Drawing Sheets

SPONGE MOP

BACKGROUND OF THE INVENTION

1. Field of the Invention.

This invention pertains to cleaning devices, and more particularly to apparatus for washing floors.

2. Description of the Prior Art.

Various products have been developed to assist homemakers and professional housekeeping personnel to clean floors. Such items as brooms and mops are in widespread use. A particularly popular type of mop is the sponge mop, wherein a sponge is fastened to the end of a handle. To remove water from the sponge, it is known to provide the mop with a water wringing mechanism that compresses and squeezes the sponge.

In some sponge mops, the wringing mechanism folds the sponge approximately in half such that the working surface is divided into two parts that bear against each other to squeeze water from the sponge. Examples of such mops can be seen in U.S. Pat. Nos. 2,834,974; 2,858,557; 2,864,107; 3,038,188; and 3,224,025.

In the design of U.S. Pat. No. 3,271,804, two sponges are placed on respective adjacent backing plates. In the working mode, the sponges are generally coplanar. The mop includes a mechanism for pivoting one of the backing plates and associated sponge through approximately 180 degrees such that the working surfaces of the two sponges are in contact to squeeze out the water in them.

U.S. Pat. No. 3,205,520 shows a mop structure having a single sponge and a pivot plate. In the working mode, the pivot plate is held away from the sponge. To squeeze water from the sponge, the plate is pivoted to contact the sponge working surface and to compress the sponge.

Despite their general acceptance, prior sponge mops of all types suffer a distinct disadvantage. That disadvantage is that they are not suitable for cleaning within the toespaces that underlie overhanging cupboards, short-legged cabinets, and similar furniture. In all known sponge mops, the various components of the wringing mechanisms are located so as to prevent the sponge from being inserted fully into a toespace before the wringing mechanism strikes the front face of the cupboard. Consequently, any attempt to clean in the toespace is not only futile but also an invitation to scratch or otherwise damage the cupboard or other furniture item.

Thus, a need exists for a sponge mop that is capable of cleaning floor areas under overhanging furniture.

SUMMARY OF THE INVENTION

In accordance with the present invention, an improved sponge mop is provided that is able to safely and effectively clean a cupboard or other furniture toespace. This is accomplished by apparatus that includes a reinforced sponge that extends beyond the perimeter of a sponge wringing mechanism.

The improved sponge mop may have several generally conventional components. Those components include a long handle, to one end of which is attached a sponge assembly and a mechanism for wringing water from the sponge. The sponge wringing mechanism may be any of several designs capable of selectively compressing the sponge to squeeze water from it, including roller operated mechanisms. The sponge assembly comprises backing plates mounted to the wringing mechanism and a sponge attached to the backing plates. The sponge material may be generally conventional. However, the sponge extends several inches beyond the perimeter of the sponge assembly backing plates and the wringing mechanism.

In the preferred embodiment, the sponge is split longitudinally into two layers. A flexible reinforcement plate is sandwiched between the two sponge layers. The reinforcement plate has the same general outline as the two sponge layers. The reinforcement plate is designed to combine flexibility for folding with the sponge under the action of the wringing mechanism and stiffness for compressing the sponge sections that extend outside of the backing plates and wringing mechanism. In one embodiment of the invention, the reinforcement plate is made with two different thicknesses. A relatively thin section is located along the sponge center section that is folded during the wringing process. Thicker sections are located at the ends of the sponge remote from the center section.

The sponge layers extend outside the wringing mechanism perimeter a sufficient distance to enable the sponge ends to penetrate fully into a toespace without damaging the cupboards or other furniture. When it is desired to squeeze water from the sponge, the relatively stiff ends of the reinforcement plate provides rigid backing for the sponge ends, thereby enabling them to be squeezed of water in the same fashion as the sponge portions backed by the backing plates.

Other advantages, benefits, and features of the invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
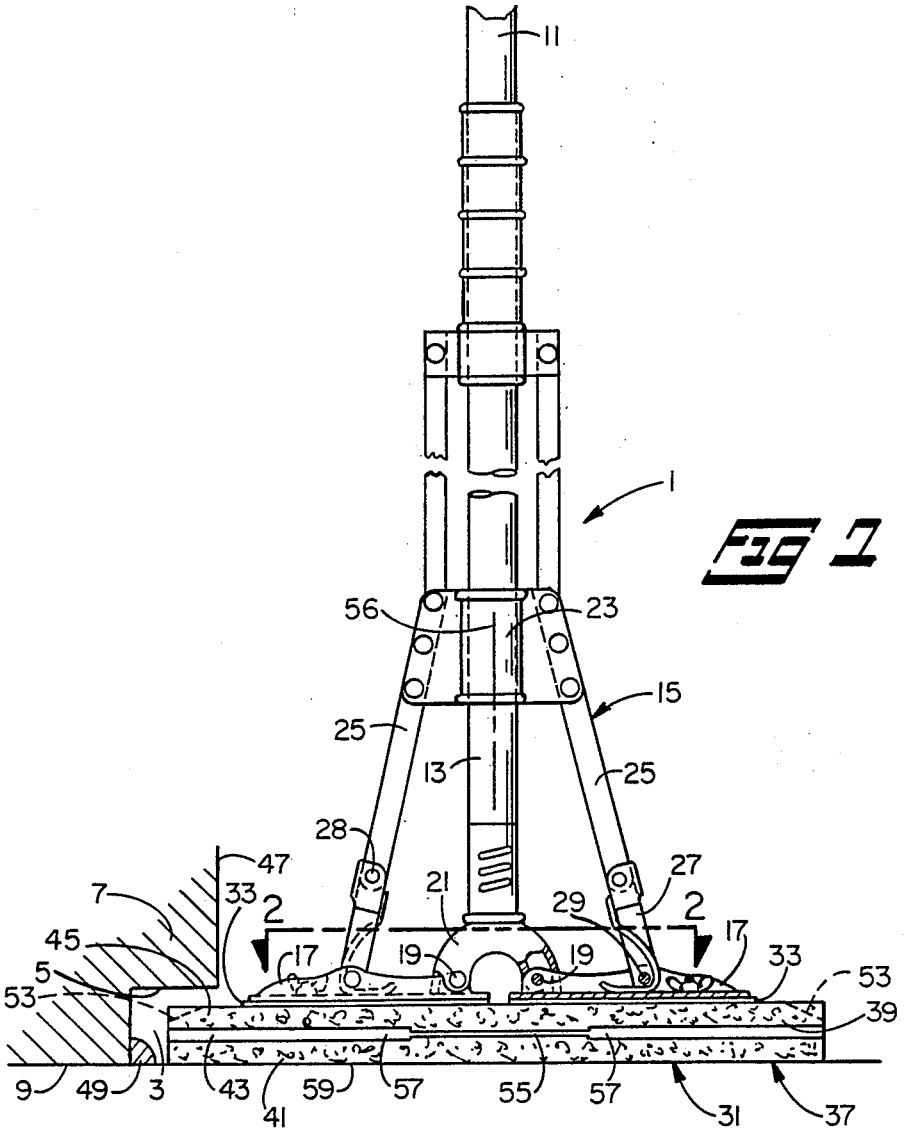
FIG. 1 is a front view of the improved sponge mop of the present invention in the cleaning mode.
Figure 2:
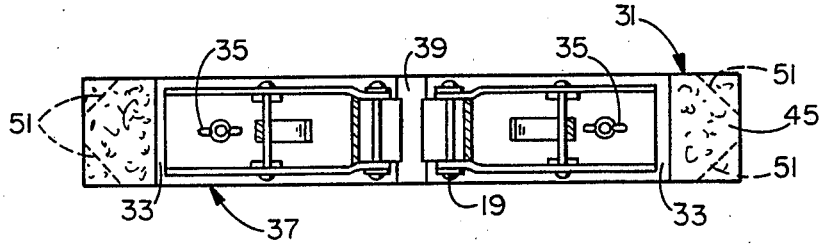
FIG. 2 is a view taken along lines 2—2 of FIG. 1.

Referring to FIGS. 1 and 2, a sponge mop 1 is illustrated that includes the present invention. The sponge mop 1 is particularly useful for cleaning a toespace 3 under an overhang 5 of a cupboard 7, a short-legged cabinet, or a similar furniture fixture. However, it will be understood that the invention is not limited to applications involving the cleaning of a floor 9.

The sponge mop 1 comprises an elongated handle 11, to the lower end 13 of which is attached a wringing mechanism 15. The wringing mechanism 15 may be of any suitable type. Wringing mechanisms that incorporate rollers are entirely satisfactory. In the illustrated construction, the wringing mechanism comprises a pair of flat bars or channels 17 pivotally connected at 19 to a bracket 21 secured to the handle lower end 13. Slidingly received over the handle 11 is a sleeve 23. Fixed to the sleeve 23 are a pair of arms 25. Links 27 pivotally connect at 28 to the free ends of the respective arms 25 and to points 29 approximately at the middle of the respective channels 17.

Fastened to the wringing mechanism channels 17 is a sponge assembly 31. The sponge assembly 31 includes a pair of backing plates 33 that are mounted to the channels by any suitable means, such as wing nuts 35 engaging upstanding studs 36 fixed to the backing plates and passing through holes in the channels. Alternately, mounting of the backing plates 33 may be by means of ridged pins of a resilient material designed to snap into cooperating holes, not shown in the drawings, in the channels.

In accordance with the present invention, the sponge assembly 31 further comprises a reinforced sponge 37. The reinforced sponge 37 is made of three components: an upper sponge layer 39, a lower sponge layer 41, and a reinforcement plate 43 sandwiched between and bonded to the two sponge layers. The upper sponge layer 39, lower sponge layer 41, and reinforcement plate 43 have the same general outline when viewed from the top, FIG. 2. The ends 45 of the two sponge layers and the reinforcement plate extend for several inches beyond the corresponding ends of the wringing mechanism channels 17 and the sponge assembly backing plates 33. The extension of the sponge layers and the reinforcement plate ends 45 is sufficient for them to penetrate completely into the toespace 3 under a cupboard 7 without the wringing mechanism 15 striking and damaging the cupboard front face 47. To improve cleaning in corners and around stationary objects, the side corners of the sponge layers and reinforcement plate may be beveled, as along phantom lines 51. In addition, the top corners of the upper sponge layer 39 may be beveled, as at phantom lines 53.

In the sponge assembly 31 illustrated in FIG. 1, the reinforcement plate 43 has two different thicknesses. The center section 55 is relatively thin so as to be flexible and resilient. The center section 55 may extend approximately 1 ½ inches on either side of the mop center line 56. The reinforcement plate outer sections 57 are relatively thick, so as to provide resistance against bending. The reinforcement plate may be made of a molded thermoplastic material having good elasticity and fatigue properties. Alternately, a corrosion resistant metal may be used for the reinforcement plate.

In FIGS. 1 and 2, the sponge mop wringing mechanism 15 is shown in the cleaning mode, whereat the sleeve 23 is at a location remote from the handle end 13. In the cleaning mode, the sponge assembly backing plates 33 are generally coplanar. In addition, the working surface 59 of the lower sponge layer 41 is generally flat. The sponge mop is capable of cleaning a floor 9 with the lower sponge layer working surface 59, and the toespace 3 with the sponge assembly ends 45.

Figure 3:
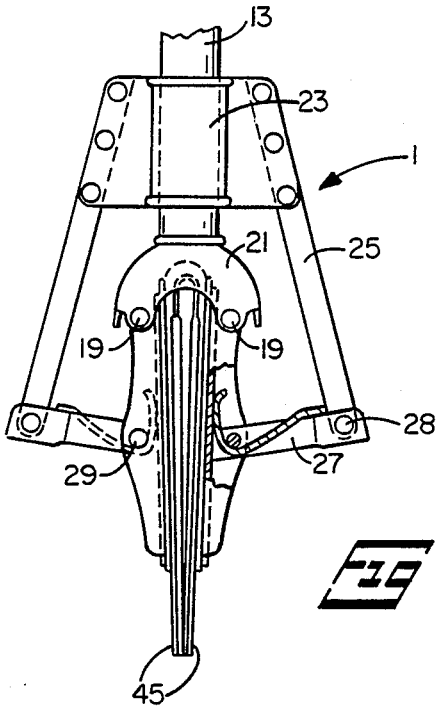
FIG. 3 is an end view of the improved sponge mop shown in the wringing mode.

In FIG. 3, the sponge mop 1 is shown in the wringing mode, in which water is squeezed out of the sponge assembly 31. For the particular wringing mechanism 15 shown, the wringing mode is attained by sliding the sleeve 23 along the handle 11 toward the handle lower end 13. Doing so causes the links 27 to pivot about the pivots 28 on the arm free ends and about the pivots 29 on the wringing mechanism channels 17. Simultaneously, the shallow channels pivot about their respective pivots 19 on the bracket 21. As a result, the sponge assembly 31 folds over against itself in a generally U-shape. The working surface 59 of the lower sponge layer 41 folds over to form two surfaces in contact. The center section 55 of the reinforcement plate 43 readily allows bending thereof with the sponge layers. At the same time, the relatively thick and rigid end sections 57 of the reinforcement plate enable a wringing force applied from the sleeve and through the wringing mechanism channels 17 and the sponge assembly backing plates 33 to be transferred to the overhanging ends 45 of the sponge assembly, thereby causing water to be squeezed from the opposed ends of the lower sponge layer.

Figure 4:
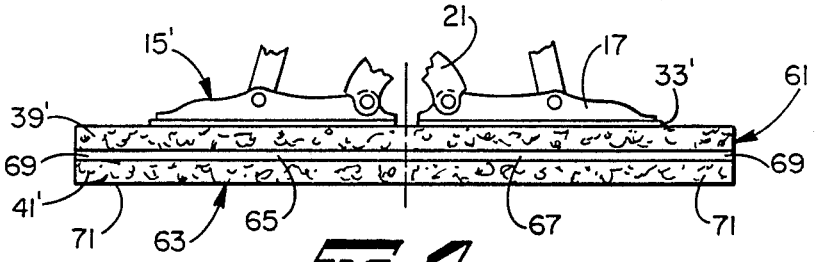
FIG. 4 is a front view of a modified embodiment of the present invention.

Turning to FIG. 4, a modified sponge mop 61 is illustrated. The sponge mop 61 is very similar to the sponge mop 1 described in connection with FIGS. 1–3. The sponge mop 61 has a handle, a wringing mechanism 15', and a sponge assembly 63. The sponge assembly 63 is generally similar to the sponge assembly 31 of FIGS. 1–3, having backing plates 33', an upper sponge layer 39', a lower sponge layer 41', and a reinforcement plate 65 interposed between the two sponge layers. The ends 71 of the sponge layers 39' and 41' and of the reinforcement plate 65 extend beyond the perimeter of the wringing mechanism 15'. The reinforcement plate 65 is of a single thickness. The reinforcement plate 65 is designed to combine flexibility at the center section 67 thereof with rigidity at the end sections 69. In that manner, the reinforcement plate 65 enables water to be squeezed from the overhanging ends 71 of the opposed lower sponge layer when the wringing mechanism 15' is in a wringing mode similar to that shown in FIG. 3.

Figure 5:
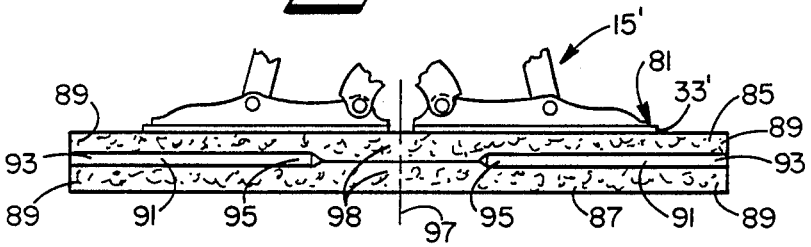
FIG. 5 is a front view of a further modified embodiment of the present invention.

Now looking at FIG. 5, a sponge mop 81 has a wringing mechanism 15' with a sponge assembly 83 mounted thereto by means of backing plates 33'. The sponge assembly 83 has a upper sponge layer 85 and a lower sponge layer 87 with respective ends 89 that extend beyond the backing plates 33' and the wringing mechanism 15'. Sandwiched between the sponge layers 85 and 87 are a pair of relatively short and stiff reinforcement plates 91. Each reinforcement plate 91 has an outer end 93 that is located between the respective ends 89 of the sponge layers 85 and 87. The inner ends 95 of the reinforcement plates 91 terminate a distance from the sponge mop centerline 97; a preferred distance is approximately 1 ½ inches. It is possible for the center sections 98 of the two sponge layers to contact each other in the area between the inner ends 95 of the reinforcement plates 91.

In the construction of FIG. 5, the reinforcement plates 91 are able to transfer a force from the wringing mechanism 15' and the backing plates 33' to the overhanging ends 89 of the lower sponge layer 87 when the sponge mop 81 is in the wringing mode, similar to FIG. 3. At the same time, the center section of the sponge assembly 83 is entirely free to flex between the cleaning mode and the wringing mode.

Thus, it is apparent that there has been provided, in accordance with the invention, an improved sponge mop that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An improved sponge mop comprising:

a. a handle having a longitudinal axis;

b. wringing means attached to the handle for selectively receiving a wringing force and operating between a cleaning mode and a wringing mode; and c. a sponge assembly mounted to the wringing mechanism comprising:

i. a pair of backing plates having a predetermined perimeter and mounted to the wringing means for being actuated thereby between the cleaning mode and the wringing mode in response to the wringing force received by the wringing mechanism, the backing plates being generally coplanar when the wringing means is in the cleaning mode and generally parallel and spaced a predetermined distance apart when the wringing means is in the wringing mode;

ii. an upper sponge layer attached to the backing plates and having opposed ends that extend for a substantial predetermined distance beyond the perimeter of the wringing means and the backing plates;

iii. a lower sponge layer generally coterminous with the upper sponge layer and having a working surface; and iv. a reinforcement plate interposed between and bonded to the upper and lower sponge layer, and being generally coterminous therewith, the upper and lower sponge layers and the reinforcement plate being generally planar when the wringing means and the backing plates are in the cleaning mode and being folded over into a generally U-shape to form the lower sponge layer working surface into two portions that are in contact with each other when the wringing means is in the wringing mode, the reinforcement plate having sufficient rigidity to transfer the wringing force from the wringing means and the backing plates to the ends of the lower sponge layer that extend beyond the perimeter of the wringing means and the backing plates to squeeze water therefrom when the wringing means is in the wringing mode.

2. The improved sponge mop of claim 1 wherein the reinforcement plate has a uniform thickness.

3. The improved sponge mop of claim 1 wherein the reinforcement plate has a center section having a first predetermined thickness and end sections proximate the respective opposed ends of the upper and lower sponge layers of a second predetermined thickness greater than the first predetermined thickness, so that the reinforcement plate center section provides flexibility to the sponge assembly when the wringing means is folded to the wringing mode and the end sections provide stiffness and rigidity for applying a wringing force to the opposed ends of the lower sponge layer that extend beyond the perimeter of the wringing means and the backing plates.

4. An improved sponge mop comprising:

a. a handle having a longitudinal axis;

b. wringing means attached to the handle for selectively receiving a wringing force and operating between a cleaning mode and a wringing mode; and c. a sponge assembly mounted to the wringing mechanism comprising:

i. a pair of backing plates having a predetermined perimeter, the backing plates being mounted to the wringing means for being actuated thereby between the cleaning mode and the wringing mode in response to the wringing force received by the wringing mechanism, the backing plates being generally coplanar when the wringing means is in the cleaning mode and generally parallel and spaced a predetermined distance apart when the wringing means is in the wringing mode;

ii. an upper sponge layer attached to the backing plates and having opposed first and second ends that extend for respective substantial predetermined distances beyond the perimeter of the wringing means and the backing plates;

iii. a lower sponge layer having first and second ends that are generally coterminous with the corresponding ends of the upper sponge layer and having a working surface; and iv. first and second reinforcement plates, the first reinforcement plate being interposed between and bonded to the upper sponge layer and the lower sponge layer, the first reinforcement having an outer end that is coterminous with the second ends of the upper and lower sponge layers, the second reinforcement plate being interposed between and bonded to the upper sponge layer and the lower sponge layer and having an outer end that is coterminous with the second ends of the upper and lower sponge layers, so that the upper and lower sponge layers have unhindered flexibility when folded over into a generally U-shape when the wringing means is operated to the wringing mode and the force applied to the wringing means and to the backing plates in the wringing mode is transferred by the reinforcement plates to the opposed ends of the lower sponge layer that extend beyond the perimeter of the wringing means and the backing plates to squeeze water from the lower sponge layer opposed ends.

5. In a sponge mop having an elongated handle; a pair of backing plates having a predetermined perimeter and being pivotally attached to the handle; and wringing means having a perimeter generally coterminous with the backing plates perimeter for pivoting the backing plates under a wringing force between a cleaning mode wherein the backing plates are generally coplanar and a wringing mode wherein the backing plates are generally parallel and spaced apart a predetermined distance, the improvement comprising:

a. a first sponge layer attached to the backing plates and having opposed ends that extend for a predetermined distance beyond the perimeter of the backing plates and the wringing means;

b. a second sponge layer generally coterminous with the first sponge layer; and c. a reinforcement plate generally coterminous with and sandwiched between and bonded to the first and second sponge layers, so that the first and second sponge layers and the reinforcement plate are generally flat when the wringing means and the backing plates are in the cleaning mode and the first and second sponge layers and the reinforcement plate fold over into a generally U-shape and are between the parallel backing plates when the wringing means and the backing plates are in the wringing mode and the wringing force applied to the wringing means is transferred therefrom to the backing plates and to the opposed ends of the second sponge layer that extend beyond the perimeter of the wringing means and the backing plates to thereby enable water to be squeezed from the opposed ends of the second sponge layer.

6. The improvement of claim 5 wherein the reinforcement plate has a uniform thickness.

7. The improvement of claim 5 wherein the reinforcement plate has a center section having a first predetermined thickness and end sections proximate the respective opposed ends of the first and second sponge layers of a second predetermined thickness greater than the first predetermined thickness, so that the reinforcement plate center section provides flexibility to the first and second sponge layers when the wringing means is in the wringing mode and the reinforcement plate end sections provide stiffness and rigidity for transferring the wringing force to the opposed ends of the first and second sponge layers from the wringing means and the backing plates.

8. In a sponge mop having an elongated handle; a pair of backing plates having a predetermined perimeter and pivotally attached to the handle; and wringing means having a perimeter generally coterminous with the backing plates for pivoting the backing plates under a wringing force between a cleaning mode wherein the backing plates are generally coplanar and a wringing mode wherein the backing plates are generally parallel and spaced apart a predetermined distance, the improvement comprising:

a. a first sponge layer attached to the backing plates and having opposed first and second ends that extend for a predetermined substantial distance beyond the perimeter of the backing plates and the wringing means;

b. a second sponge layer generally coterminous with the first sponge layer; and c. first and second reinforcement plates, the first reinforcement plate being interposed between and bonded to the first and second sponge layers, the first reinforcement plate having an outer end that is coterminous with the first ends of the first and second sponge layers, the second reinforcement plate being interposed between and bonded to the first and second sponge layers, the second reinforcement plate having an outer end that is coterminous with the second ends of the first and second sponge layers, so that the first and second sponge layers have great flexibility when folded over into a generally U-shape when the wringing means is operated to the wringing mode and the force applied to the wringing means and the backing plates when in the wringing mode is transferred to the reinforcement plates and to the opposed ends of the second sponge layer that extend beyond the perimeter of the wringing means and the backing plates to squeeze water from the lower sponge layer opposed ends.

* * * * *